US009209565B2

(12) United States Patent
Michel et al.

(10) Patent No.: US 9,209,565 B2
(45) Date of Patent: Dec. 8, 2015

(54) ELECTRICAL CONNECTOR HAVING AN INSULATING BODY THAT IS LOCKED IN PLACE ON THE PLUG SIDE AND CAN BE RELEASED BY A TOOL

(71) Applicant: CONINVERS GmbH, Herrenberg (DE)

(72) Inventors: Markus Michel, Nagold (DE); Manfred Brode, Oschelbronn (DE)

(73) Assignee: CONINVERS GmbH, Herrenberg (DE)

( * ) Notice: Subject to any disclaimer, the term of this patent is extended or adjusted under 35 U.S.C. 154(b) by 67 days.

(21) Appl. No.: 14/087,848

(22) Filed: Nov. 22, 2013

(65) Prior Publication Data

US 2014/0148032 A1 May 29, 2014

(30) Foreign Application Priority Data

Nov. 26, 2012 (EP) ..... 12401236

(51) Int. Cl.

| | |
|---|---|
| ***H01R 13/506*** | (2006.01) |
| ***H01R 9/03*** | (2006.01) |
| ***H01R 43/22*** | (2006.01) |
| ***H01R 13/639*** | (2006.01) |
| ***H01R 13/508*** | (2006.01) |
| *H01R 13/426* | (2006.01) |
| *H01R 107/00* | (2006.01) |

(52) U.S. Cl.

CPC ..... *H01R 13/639* (2013.01); *H01R 13/508* (2013.01); *H01R 43/22* (2013.01); *H01R 13/426* (2013.01); *H01R 13/506* (2013.01); *H01R 2107/00* (2013.01)

(58) Field of Classification Search

CPC ..... H01R 13/506; H01R 9/03; H01R 43/22; H01R 13/426

USPC ..... 439/304, 266; 29/270

See application file for complete search history.

(56) References Cited

FOREIGN PATENT DOCUMENTS

| | | | |
|---|---|---|---|
| DE | 91 04 985 | U1 | 10/1991 |
| DE | 296 07 340 | U1 | 7/1996 |
| DE | 20 2005 017979 | U1 | 2/2006 |
| DE | 20 2007 005073 | U1 | 6/2007 |
| EP | 2 056 411 | A2 | 5/2009 |
| WO | WO 01/18918 | A1 | 3/2001 |

OTHER PUBLICATIONS

English Translation of Coninvers Elektrotechnische DE 20 2005 017 979, published Nov. 15, 2005.*

English Translation of Coninvers Elektrotechnische DE 20 2007 005 073, filed Apr. 5, 2007.*

English Translation of Torsten FR 2 722 620, filed Jul. 13, 1995.*

European Search Report for corresponding Application No. EP 12 401 236.0 dated Apr. 2, 2013.

* cited by examiner

*Primary Examiner* — Amy Cohen Johnson
*Assistant Examiner* — Matthew T Dzierzynski
(74) *Attorney, Agent, or Firm* — Renner, Otto, Boiselle & Sklar, LLP

(57) ABSTRACT

The electrical connector, having a tubular housing section, in which an insulating body is arranged which bears an electrical contact and is locked to the housing section via a locking device, which is engages with a receiving recess of the housing section, wherein the locking device has at least one flexible supporting element for the insulating body and the insulating body of the housing section is able to be unlocked releasably by a tool. According to the invention, the insulating body is releasable from the plug side of the housing section by a tool and the locking device and the receiving recess are realized separately in the circumferential direction of the housing section and have at least two locking parts that are separated from one another and a corresponding number of locking part receptacles which are at a distance to one another laterally.

11 Claims, 6 Drawing Sheets

ELECTRICAL CONNECTOR HAVING AN INSULATING BODY THAT IS LOCKED IN PLACE ON THE PLUG SIDE AND CAN BE RELEASED BY A TOOL

CROSS-REFERENCE TO RELATED APPLICATION

The present application claims priority under 35 USC §119 to European Patent Application No. 12 401 236.0, filed Nov. 26, 2012, the entire disclosure of which is incorporated herein by reference.

TECHNICAL FIELD OF THE INVENTION

The invention relates to an electrical connector to connect a mating connector, having a tubular housing section, in which an electrical insulating body bearing plug contacts is arranged, wherein the housing section has a plug side for the mating connector as well as a connection side for the plug contacts and locks the insulating body in place in the housing section and is able to be unlocked releasably by a tool, and wherein at least one locking device is arranged between the housing section and the insulating body, said locking device being held in the housing section so that it is axially immovable and at least partially engaging in a receiving recess of the housing section, and having at least one supporting element for the insulating body that is able to be flexibly directed radially, said supporting element locking the insulating body in place in the housing section and fixing it in the axial direction. Furthermore, the invention relates to an unlocking tool for the insulating body of such an electrical connector.

DESCRIPTION OF THE RELATED ART

Connectors of the type named at the beginning are known in various embodiments from prior art. Therein, the locking device is designed in such a way that it securely connects the insulating body to the plug contacts which are received therein and in particular prevents an unintentional release of the insulating body from the connector housing. This is necessary to, on the one hand, prevent damage to the contact of the strand conductor to the electrical contacts through mechanical influences, and to, on the other hand, protect people coming into contact with the connector from dangerous voltages.

In the case of known connectors, insulating bodies are mostly introduced into the receiving housing section from a rear end allocated to the connection lines, until the insulating body fits onto a stop of the connector housing and subsequently, for example, fits into the housing section with a snap ring or similar, said housing section engaging with a annular groove provided there and supporting the insulating body. Alternatively it is known, firstly to introduce a snap ring into the housing section provided to receive the insulating body, to lock it there and subsequently to introduce the insulating body into the housing section, wherein the snap ring autonomously locks the insulating body. Therein, the locking can be formed to be unreleasable or releasable by a tool, depending on whether the snap ring is arranged accessibly or not.

Therein it has proven to be disadvantageous, in particular in panel mount connectors for the initial assembly and for cases of maintenance and repair, if the insulating body is releasable by a tool from the connection side of the electrical plug contacts, as in such a case, the connector housing must be released from the machine housing in order to carry out the unlocking of the insulating body. This additional expenditure is generally undesired. To avoid this disadvantage, connectors that are releasable by tools are known from prior art, in which a snap ring is accessible in the receiving housing section from the plug side or the connection side of the connector housing. Thus, the insulating body that is locked in place can be released from the housing section without problem by means of a suitably formed unlocking tool and displaced in an axial direction. For example, reference is made to the registered patent DE 91 04 985 U1.

This suggests holding the insulating body arranged in a plug or coupling housing by means of snap ring, which touches in sections on its front surface that is external in the insertion direction and which is supported in a annular groove of the respective housing, wherein the other internal front face of the insulating body is supported on a ring collar. The snap ring has at least four supporting collars which are arranged equally distributed over its area and which fit onto a front surface of the insulating body that is displayed in the insertion direction. It is formed in particular as a whole as a cylindrical annular body, which is tiered in the circumferential direction. The document leaves it open as to whether the insulating body therein is able to be unlocked from the plug side or the connection side of the connector and which is then displaceable in the direction with respect to the receiving housing section of the insulating body.

A disadvantage of this prior art is based on the fact that the connector housing needs a internal circumferential annular groove for the snap ring, which must be manufactured by subsequent work, in particular in panel mount connectors, which are realised as a fundamentally cylinder shaped pressure casting part. Furthermore, the suggested solution therein is in particular hardly usable for plug connectors having narrow inner diameters and several electrical plug contacts.

Taking this into account, the object of the invention is to suggest a possibility that dispels the disadvantages of the prior art mentioned above, wherein the connector housing and also the locking device for the insulating body should be able to be manufactured and assembled simply and cost-effectively in one process and in particular are able to be combined with the insulating body without alteration to the existing version.

This object is solved according to the invention by an electrical connector and an unlocking tool having the features described herein.

SUMMARY OF THE INVENTION

In the electrical connector according to the invention, the insulating body is able to be released from the plug side of the tubular housing section by a tool. According to the invention, the plug connection has a locking device for the insulating body and a receiving recess for the locking device arranged in the housing section, which are realised separately in the circumferential direction of the housing section in which the insulating body is arranged. Therein the locking device has at least two shell-like locking parts that are separated from one another and the receiving recess has a corresponding number of locking part receptacles for the locking parts, said locking part receptacles being separated from one another and being arranged at a distance from one another on the inner wall of the housing section in the circumferential direction, wherein the locking parts are adapted in shape to the locking part receptacles and have at least one laterally protruding supporting element for the insulating body.

The locking parts and the locking part receptacles are dimensioned in the circumferential direction such that they would be directly extended in rows without a distance between one another in the circumferential direction only along a part of the inner wall of the housing section of the connector. They thus clearly need less room in the circumferential direction of the housing section than a locking device formed in a closed circular shape and a correspondingly realised receiving recess for such a locking device. The invention also enables a secure, releasable locking of the insulating body to the housing section from the plug side outwards in connectors, which have a connector housing with a relatively narrow inner diameter and a proportionally thin wall thickness, and indeed without significantly decreasing the stability of the plug connection housing. The at least one supporting element provided on the locking part can lock into the housing section in an annular groove of the insulating body during the locking of the insulating body and/or can lock behind an undercut of the insulating body. It can be formed on the circumferential side allocated to the insulating body with or without side locking hooks.

The locking part receptacles preferably have undercuts and the locking parts preferably have locking means allocated to the undercuts for the axial, radial and/or tangential fixing of the locking parts on the inner wall of the housing section. Therein, the undercuts can extend in the circumferential direction, in the axial direction and/or in the radial direction of the inner wall. The respective locking means, which works together with the undercuts run to the locking parts, preferably in a corresponding direction. The locking means stably connect the respective locking part to the housing section of the connector, with or without a little slackness.

In a particularly favoured embodiment of the invention, the undercuts are arranged laterally on the inner wall of the housing section in the circumferential direction of the locking receptacles. Therein they extend fundamentally in the axial direction of the inner wall of the housing section. Correspondingly, the connection to the locking parts only takes place on or along the axial side edges of the locking parts. As the locking parts are formed to be shell-like, these are able to be resiliently deformed simply, orthogonally to their side edges, such that the locking means can be simply introduced or locked into the undercuts. In order to additionally simplify the introduction, the side edges of the locking parts that extend axially and laterally in the circumferential direction can themselves be formed flexibly in the radial direction.

In a preferred embodiment of the electrical connector according to the invention, the locking parts are deeply enclosed in the locking part receptacles in such a way that only the supporting elements of the locking parts protrude over the inner wall of the housing section. Thus the insulating body can be directly supported radially on both sides next to each of the locking part receptacles and the locking parts on the inner wall of the housing section, without putting force on the locking parts, in particular on the supporting elements thereof. Thus an unintentional release of the locking between the insulating body and the receiving housing section is certainly ruled out.

In an embodiment of the invention, the at least two locking part receptacles extend from the plug side of the housing section in the axial direction of the housing section and end before the connection side thereof. They are preferably formed to be open towards the plug side of the housing section. Thus, the locking parts can be introduced into the housing section and into the locking part receptacles quickly and particularly simply from the front and there they can, for example, be determinedly locked in place. In order to further simplify the introduction into the locking part receptacles and to enable a particularly cost-effective manufacturing of the housing of the connector, the locking part receptacles are preferably formed to be open towards the plug side of the housing section. Thus the locking parts can be inserted directly in particular with their axial side edges behind the axial lateral undercuts of the locking part receptacles with minimum expenditure of power, until they are lined up on the end of the locking part receiver allocated to the connection side of the housing section and lock the locking means.

Therein it has been proven particularly favourable to form the locking part receptacles with insertion tracks for the locking parts fitted laterally in the circumferential direction. The fitted insertion tracks extend from the plug side of the housing section almost until the connection side. Therein they preferably have a length, which corresponds to the axial side edges of the locking parts.

In a favourable embodiment of the invention, the locking parts are realised with thinner walls at least in sections in the direction of the plug side of the housing section than in the direction of the connection side of the housing section. Therein the thinner-walled region borders at least the supporting element and extends axially in the direction of the plug side of the housing section. Therein, advantageously, the thinner-walled region reaches the plug side of the housing section. An embodiment is preferred in which the locking parts have at least one thin-walled circumferential section, which is formed to be open in the direction of the plug side of the housing section and extends as an axial recess at least until the supporting element. In this way, a free space is created between the respective locking part and the insulating body, which forms an entrance to the at least one supporting element of the respective locking part with a suitably formed unlocking tool for the insulating body.

In all possible embodiments of the invention, the at least two locking parts can be formed identically or differently and can have a uniform and/or non-uniform lateral distance from one another, wherein the housing section can have a larger number of locking part receptacles or even a number corresponding to the number of locking parts. Preferably, identically formed locking parts are used and are arranged at a uniform side distance from one another, wherein no more locking part receptacles are provided than locking parts.

The unlocking tool according to the invention for the insulating body of a previously described electrical connector according to the invention has at least one unlocking sleeve which is arranged on a hand grip and is fixedly connected to the handle, said unlocking sleeve being able to be partially introduced into the plug side of the housing section of the connector with a front guiding region and is supported laterally therein on the inner wall of the housing section, and a sliding sleeve which is guided moveably lengthwise into the unlocking sleeve, is able to be inserted into the plug side of the housing section with a front insertion region and is able to sit on the face of the insulating body, wherein the sliding sleeve is laterally supported with its outer wall on the inner wall of the unlocking sleeve. Therein the unlocking sleeve has at least two unlocking blades for the radial unlocking of the supporting element of the at least two locking parts from the insulating body, said unlocking blades being fitted arranged to the front of the guiding region. On the outside, the sliding sleeve has a revolving supporting collar arranged close to the front guiding region of the unlocking sleeve and protruding outwards radially, said supporting collar enabling a lateral support of the sliding sleeve on the inner wall of the housing section, wherein axially extending passages for the unlocking blades of the unlocking sleeves are provided on the supporting collar.

The sliding sleeve and the unlocking sleeve are adapted to each other in shape and to the inner wall of the housing section, in which the insulating body is arranged. The number and the arrangement of the unlocking blades therein corresponds to the locking parts provided on the supporting elements. To unlock the insulating body, the sliding sleeve is first inserted into the housing section with its insertion region, until it sits on the insulating body. Therein the sliding sleeve is supported at the front via its supporting collar on the inner wall of the tubular housing section. Subsequently, the unlocking sleeve is displaced towards the sliding sleeve in the direction of the insulating body, until the guiding region of the unlocking sleeve is covered by the insertion region of the sliding sleeve. Therein, the unlocking blades of the unlocking sleeve reach the supporting elements of the locking parts and displace these laterally and radially to the free end in the direction of the inner wall of the housing section so far that the insulating body is released. Now a small axial force on the insulating body in the plug direction, which is carried out by means of the sliding sleeve, is sufficient in order to displace this in the housing section in the direction of the connection side or to push this completely out of the housing section.

The hand grip preferably has a pressure spring, which puts spring force on the sliding sleeve in the direction of the insertion region of the unlocking sleeve. In this embodiment, as soon as the unlocking blades of the unlocking sleeve have unlocked the insulating body from the supporting elements, the spring force displaces the sliding sleeve sitting on the insulating body towards the unlocking sleeve and the hand grip and thus the insulating body autonomously in the direction of the connection side of the housing section.

The advantage of the invention is in particular that, due to the constructive formation of the fastening of the insulating body in the housing section, existing insulating bodies can be used in a new plug generation. The insertion of the insulating body can thereby even be carried out in the closed state in the new plug.

The invention is illustrated below in more detail by means of an exemplary embodiment depicted in the drawing. Further features of the invention arise from the following description of the exemplary embodiment of the invention in connection with the claims and the enclosed drawing. The individual features of the invention can be realised alone or in combination in different embodiments of the invention. Here are shown:

DETAILED DESCRIPTION OF THE INVENTION

Figure 1:
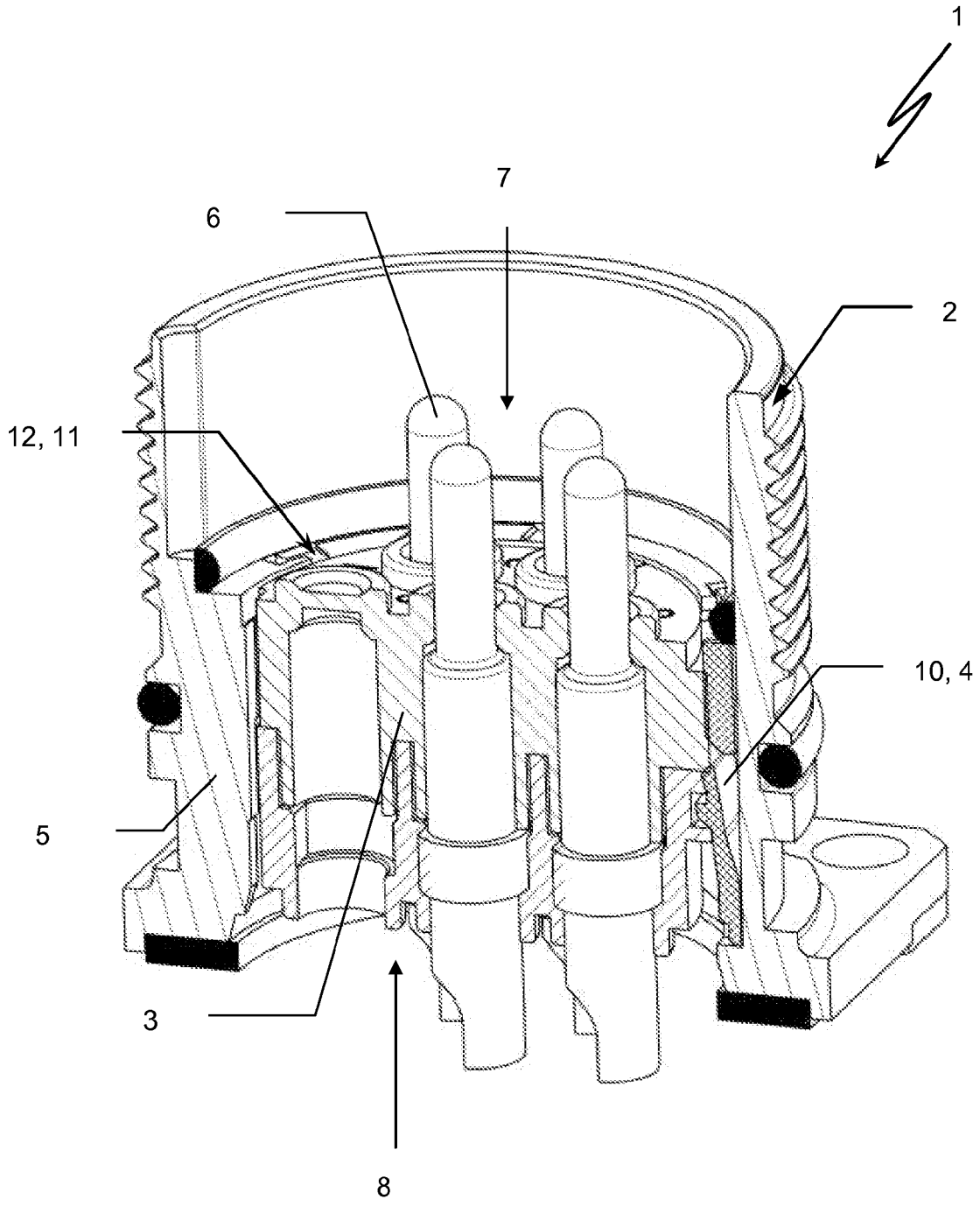
FIG. 1 an electrical connector according to the invention having an insulating body received in the housing and having locking parts which lock the insulating body in place in a housing section, in a perspective longitudinal sectional view.

FIG. 1 shows an electrical connector 1 according to the invention having an insulating body 3 received in a housing 2. The insulating body 3 is locked in place in a tubular housing section 5 of the housing 2 by means of locking parts 4. The insulating body 3 bears electrical plug contacts 6, which extend axially from a plug side 7 to a connection side 8 of the housing section 5. The insulating body 3 is able to be unlocked from the plug side 7 of the housing section 5 by means of the unlocking tool 9 depicted in FIG. 5 and then is moveable axially in the direction of the connection side 8 of the housing section 5. The locking parts 4, which form a locking device 10 for the insulating body 3, are arranged between the housing section 5 and the insulating body 3 and are held so that they are unable to be displaced axially as well as radially in the housing section. They are enclosed in or engage the locking part receiver 11 at least partially, which, seen together, depict a receiving recess 12 for the locking device 10.

Figure 3:
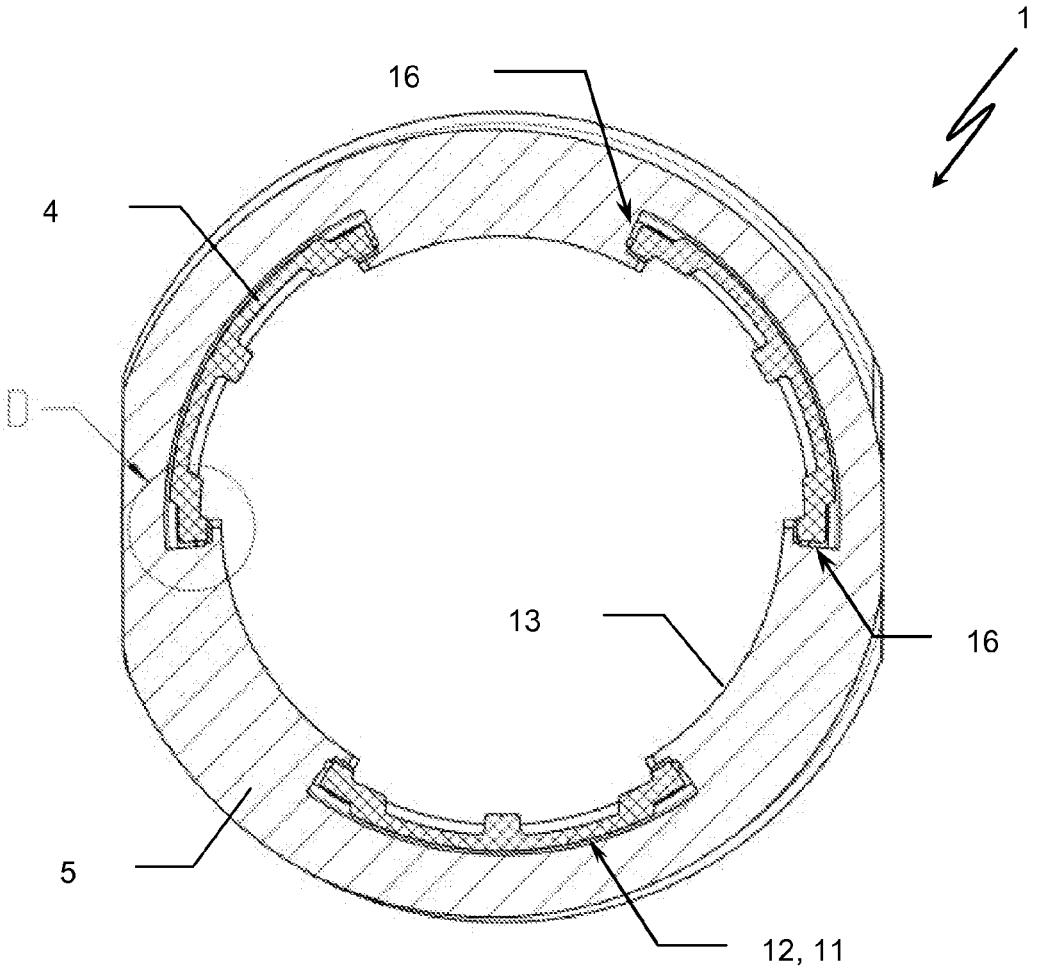
FIG. 3 the connector from FIG. 1 without an insulating body, in a cross-sectional view.
Figure 3:
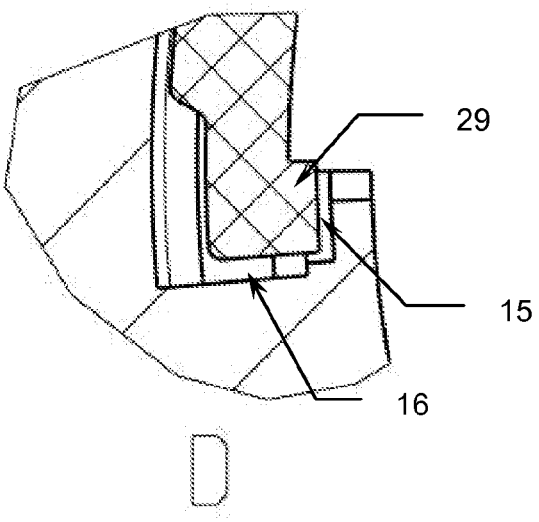
Figure 4:
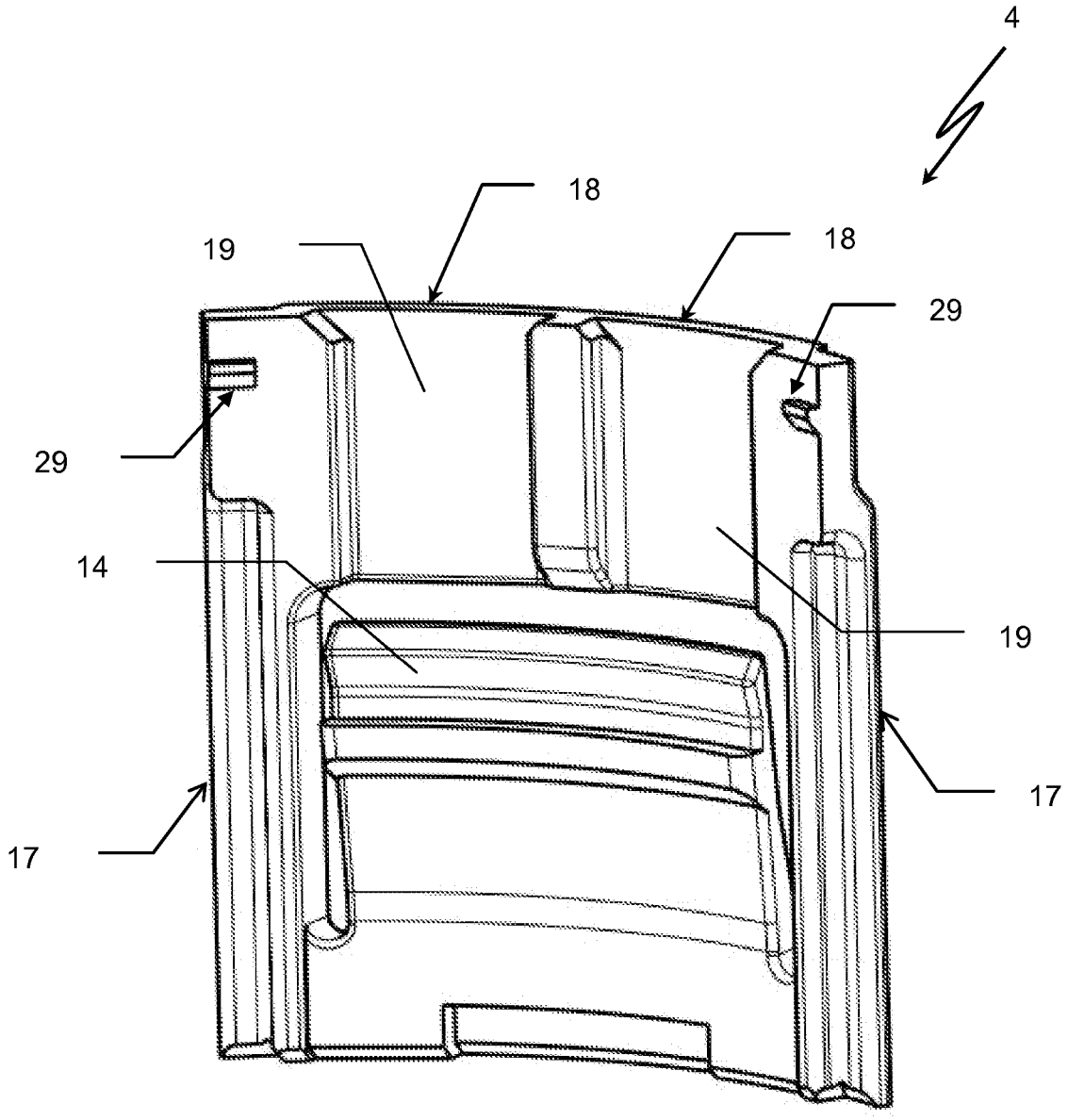
FIG. 4 the locking parts from FIG. 1, in a perspective view.

As is to be taken from FIG. 3, which shows the connector 1 in a cross-sectional view though the locking parts 4, in the depicted exemplary embodiment, the connector 1 according to the invention has three locking parts 4 arranged at equal distance to one another in the circumferential direction of the inner wall 13. In this figure, the three locking part receptacles 11 are also clearly recognisable, in which the locking parts 4 are arranged. One such locking part 4 is depicted enlarged and alone in FIG. 4. It has a central supporting element 14, which, as can be seen in FIG. 1, locks the insulating body 3 in place in the housing section 5 and fixes it in the axial direction. The supporting element 14 is formed as a locking hook. As is furthermore shown in FIG. 3, the locking parts 4 are realised in a shell shape and extend straight in the axial direction of the housing section 5 and curved in the circumferential direction of the housing section 5. This likewise applies to the supporting element 14. As is to be taken from FIG. 4, the curving of the locking parts 4 corresponds to the curved edge of the inner wall 13 of the housing section 5. FIG. 4 also shows that the locking part receptacles 11 are formed accordingly and set back towards the inner wall 13.

Figure 2:
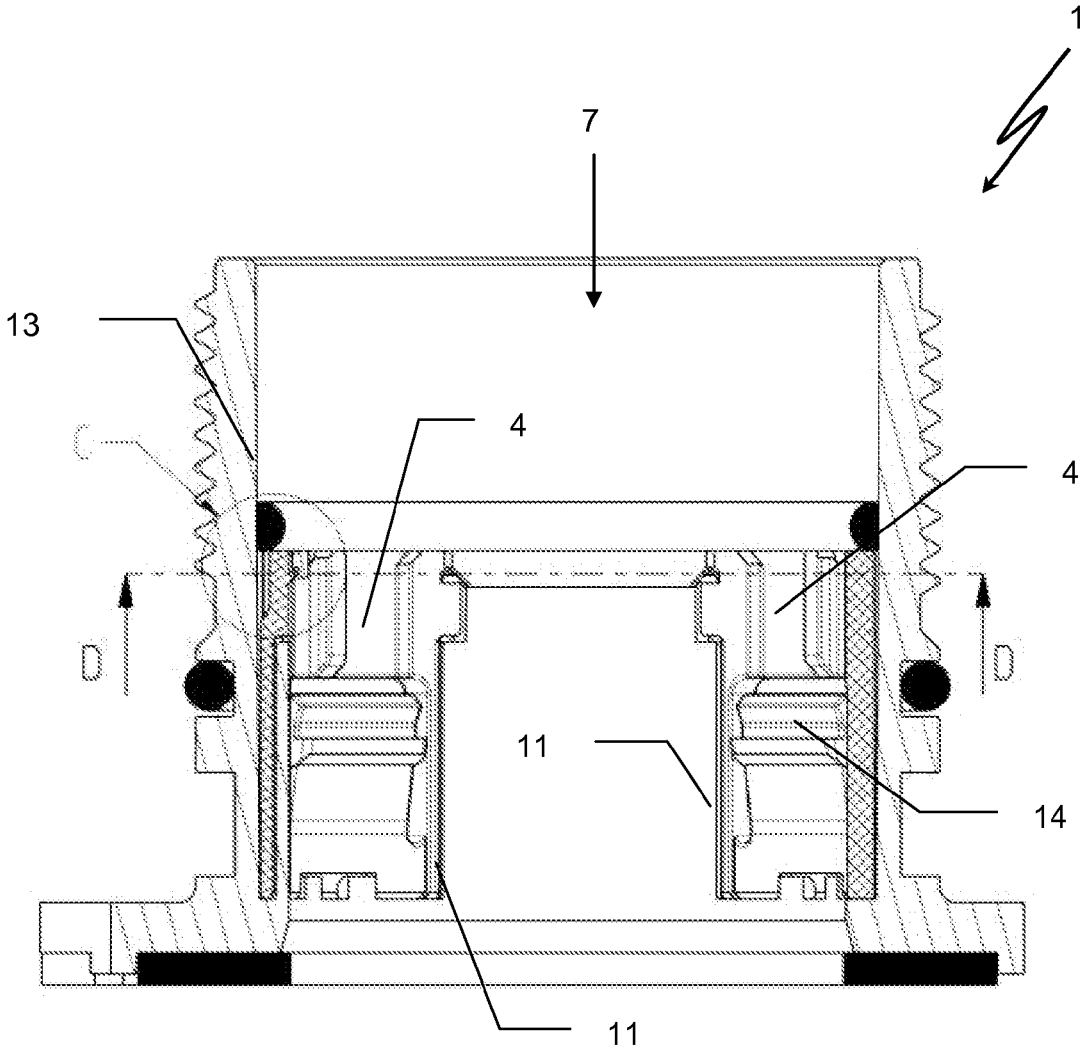
FIG. 2 the connector from FIG. 1 without an insulating body, in a longitudinal sectional view.
Figure 2:
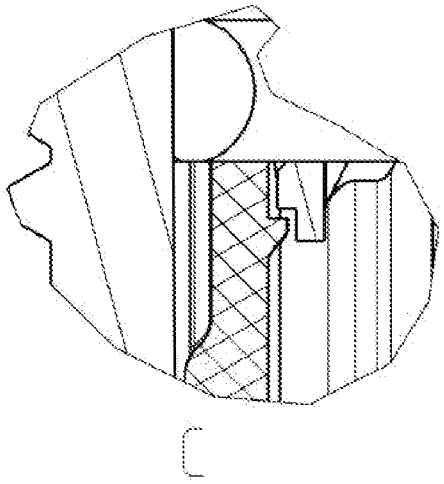

Additionally, it is clearly recognisable in FIG. 3 that the locking part receptacles 11 have undercuts 15, extending laterally and axially in the circumferential direction, as well as insertion tracks 16 for the locking parts 4. The locking part receptacles 11 are formed to be open towards the plug side 7 of the housing section 5 and extend according to FIGS. 1, 2 from the plug side 7 to just before the connection side 8 of the housing section 5. The locking parts 4 are engaged with their axial side edges 17 with the insertion tracks 16, wherein the locking parts 4 have locking means 29, visible in FIG. 4, to lock the locking parts 4 in place with the locking part receptacles 11 on the side edges 17, said locking part receptacles 11 in particular working together with the undercuts 15. In order to enable the locking, the side edges 17 are formed flexibly in the radial direction. The locking parts 4 are therein deeply enclosed in the locking part receptacles 11 in such a way that only the supporting elements 14 protrude over the inner wall 13 of the housing section 5.

As is to be taken from FIG. 4, the locking parts 4 are formed with thinner walls on two circumferential sections 18 on the front end allocated to the plug side 7 of the housing section 5 than on the rear end allocated to the connection side 8. Therein the front end of the respective circumferential section 18 is formed to be open at the front, such that an axial recess 19 is present, which extends accessibly from the outside to the respective supporting element 14. According to FIG. 5*b*, the insulating body 3 can be released from the housing section 5 by means of the unlocking tool 9 depicted in FIG. 5 through the axial recess 19.

Figure 5A:
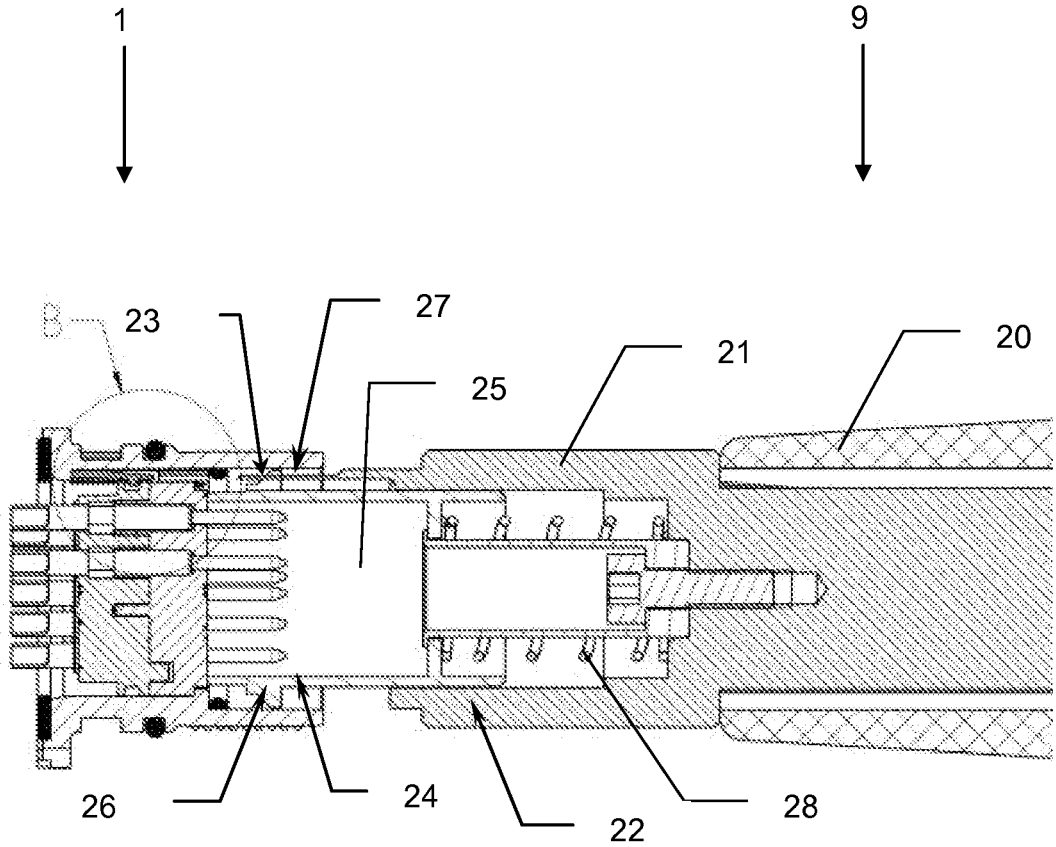
FIGS. 5*a* and 5*b* the electrical connector from FIG. 1 having a set unlocking tool according to the invention, in a longitudinal sectional view, in the locked state (FIG. 5*a*) and in the unlocked state (FIG. 5*b*) of the insulating body.
Figure 5A:
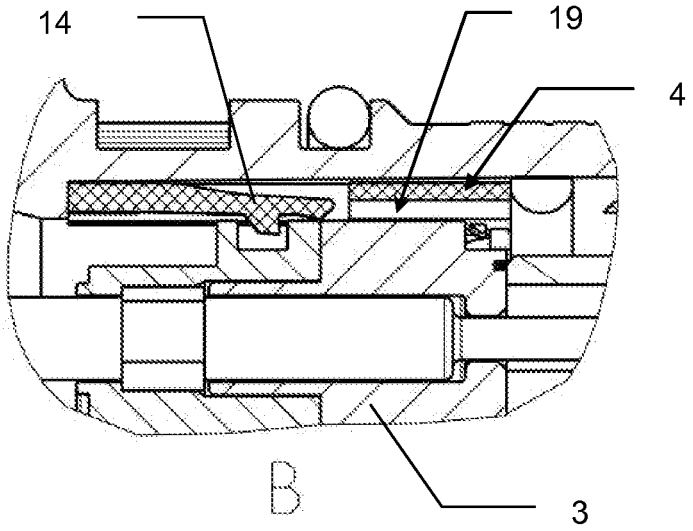
Figure 5B:
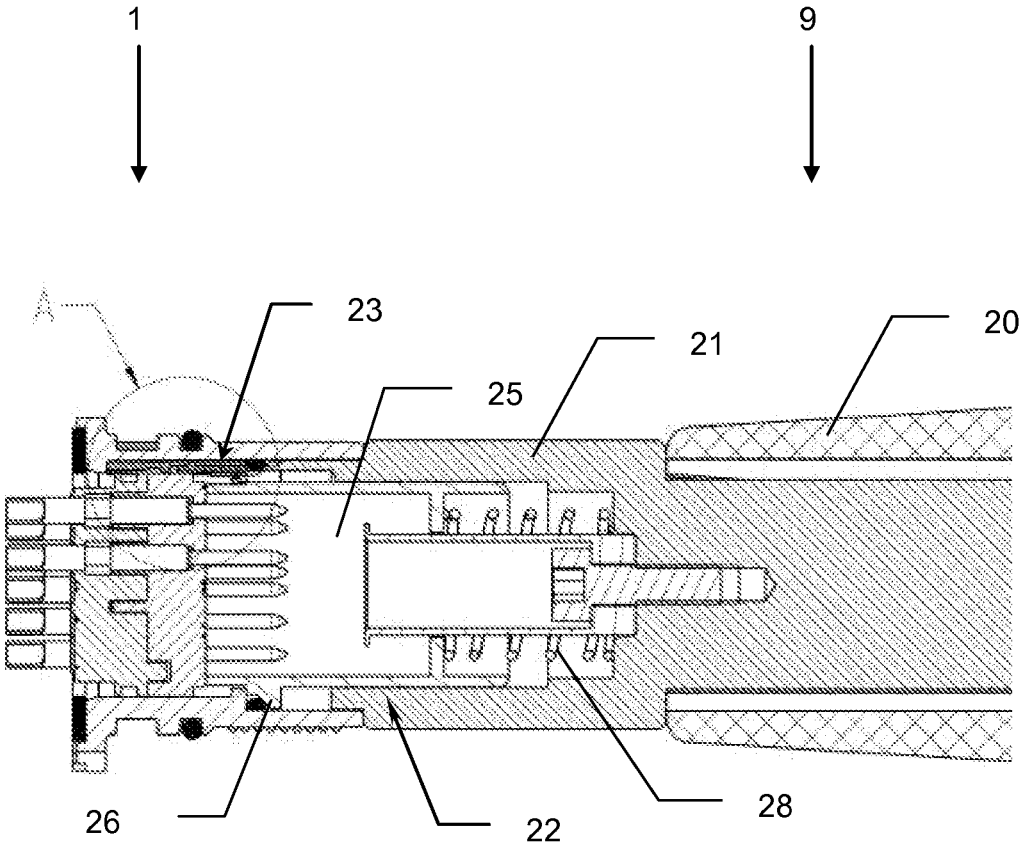
Figure 5B:
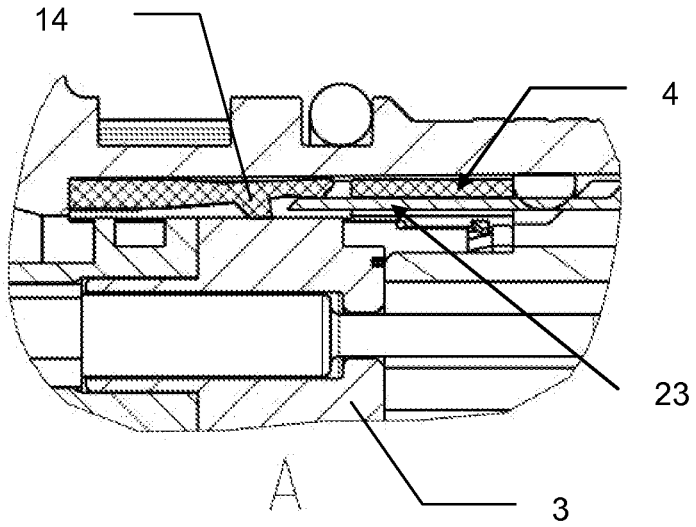

FIG. 5 shows the connector 1 depicted in the exemplary embodiment having a set unlocking tool 9 according to the invention, which is depicted in FIG. 5*a* in the locked state and in FIG. 5*b* in the unlocked state. The unlocking tool 9 has a hand grip 20 and an unlocking sleeve 21 arranged on the hand grip 20 and connected fixedly with the hand grip 20, said unlocking sleeve 21 being able to be introduced into the plug side 7 of the housing section 5 with a front guiding region 22 and being supported laterally on the inner wall 11 of the housing section 5. The unlocking sleeve 21 has three unlocking blades 23 formed on the unlocking sleeve 21 in the guiding region 22, said unlocking blades 23 being provided for the radial unlocking of the supporting elements 14 of the locking parts 4 from the insulating body 3.

Furthermore, the unlocking tool 9 has a sliding sleeve 25 that is moveably guided longitudinally into the unlocking sleeve 21 that is able to be inserted into the plug side 7 of the housing section 5 having a front insertion region 24 and that is able to be set on the face of the insulating body 3. The sliding sleeve 25 is supported outwardly and is supported inwardly by the unlocking sleeve 21. The sliding sleeve 25 has a supporting collar 26 which protrudes radially outwards close to the front guiding region 22 of the unlocking sleeve 21, said supporting collar 26 enabling a lateral support of the sliding sleeve 25 on the inner wall 13 of the housing section 5. Axially extending passages 27 are provided on the supporting collar 26 for the unlocking blades 23 of the unlocking sleeve 21.

The hand grip 20 additionally has a pressure spring 28, which exerts spring force onto the sliding sleeve 25 in the direction of the guiding region 22 of the unlocking sleeve 21 The unlocking tool 9 is introduced into the plug side 7 of the housing section 5 with the insertion region 24 of the sliding sleeve 25 for the unlocking of the insulating body 3, as is depicted in FIG. 5*a*. Subsequently, the hand grip 20 is pushed against the connector 1 in the direction of the of the insulating body 3, such that the unlocking blades 23 move through the passages 27 of the supporting collar of the sliding sleeve 25 and the supporting elements 14 swing away radially from the insulating body 3. In the unlocking position shown in FIG. 5*b*, the sliding sleeve 25 was displaced in the direction of the connection side 8 of the housing section 5, caused by the spring force of the pressure spring 28 on the insulating body 3 in the housing section 5, wherein the unlocking blades 23 formed on the unlocking sleeve 21 extend between the supporting elements 14 of the locking parts 4 and the insulating body 3.

Although the invention has been shown and described with respect to certain preferred embodiments, it is obvious that equivalents and modifications will occur to others skilled in the art upon the reading and understanding of the specification. The present invention includes all such equivalents and modifications, and is limited only by the scope of the following claims.

The invention claimed is:

1. An electrical connector to connect a mating connector, having a housing, which has a tubular housing section, in which an insulating body bearing electrical plug contacts is arranged, wherein the housing section has a plug side for the mating connector as well as a connection side for the plug contacts and the insulating body locks in place in the housing section and is able to be unlocked releasably by a tool, and wherein at least one locking device is arranged between the housing section and the insulating body, said locking device being held immovably at least axially in the housing section and being inserted at least partially into a receiving recess of the housing section and having at least one radially flexible supporting element for the insulating body, said supporting element locking the insulating body in place in the housing section and fixing it in axial direction, wherein the insulating body is releasable by a tool from the plug side of the housing section and that the locking device and the receiving recess are realised separately in the circumferential direction of the housing section, wherein the locking device has at least two shell-shaped locking parts, which are separated from one another, and the receiving recess has a corresponding number of locking part receptacles for the locking parts, which are separated from one another, which are all arranged at a distance from one another on the inner wall of the housing section in the circumferential direction, wherein the locking parts are adapted to the locking part receptacles and have respectively at least one support element for the insulating body, which is sticking out laterally, and wherein the at least two locking part receptacles extend from the plug side of the housing section in axial direction of the housing section and end before the connection side.

2. The connector according to claim 1, wherein, the locking part receptacles have undercuts and the locking parts have allocated locking means, which fix the locking parts at the housing section.

3. The connector according to claim 1, wherein the undercuts are arranged laterally in the circumferential direction of the locking part receptacles.

4. The connector according to claim 2, wherein the axial side edges of the locking parts running transversely to the circumferential direction are formed flexibly in the radial direction.

5. The connector according to claim 1, wherein the locking parts are enclosed deeply in the locking part receptacles in such a way that only the supporting elements protrude over the inner wall of the housing section.

6. The connector according to claim 1, wherein the locking part receptacles are formed to be open towards the plug side of the housing section.

7. The connector according to claim 1, wherein the locking part receptacles have in circumferential direction laterally formed insertion tracks to receive the side edges of the locking parts.

8. The connector according to claim 1, wherein the locking parts are realised with thinner walls at least in sections in the direction of plug side than in the direction of the connection side.

9. The connector according to claim 8, wherein the locking parts have at least one thin-walled circumferential section, which is formed to be open in the direction of the plug side and extends as an axial recess at least until the supporting element.

10. The unlocking tool for the insulating body of an electrical connector having the features of claim 1, comprising an unlocking sleeve that is arranged on a hand grip and is connected fixedly with the hand grip, said unlocking sleeve being able to be introduced into the plug side of the housing section of the electrical connector partially with a front guiding region and being supported laterally therein on the inner wall of the housing section, unlocking blades, fitted onto the face of the guiding region and formed on the unlocking sleeve, for the radial unlocking of the supporting elements of the at least two locking parts from the insulating body, a sliding sleeve, which is movably guided longitudinally in the unlocking sleeve and is able to be introduced into the plug side of the housing section with a front insertion region and is set on the face of the insulating body, wherein the sliding sleeve is supported outwardly and is supported inwardly on the unlocking sleeve, and a supporting collar that is arranged close to the front guiding region of the unlocking sleeve on the sliding sleeve at a distance radially and outwardly, said supporting collar enabling a lateral support of the sliding sleeve on the inner wall of the housing section, wherein the supporting collar has axially extending passages for the unlocking blades of the unlocking sleeve.

11. The unlocking tool according to claim 10, wherein the hand grip has a pressure spring, which exerts spring force onto the sliding sleeve in the direction of the insertion region of the unlocking sleeve.

* * * * *